US010815625B2

(12) United States Patent
De Maria

(10) Patent No.: US 10,815,625 B2
(45) Date of Patent: Oct. 27, 2020

(54) MAT MADE OF WATERPROOF PLASTIC MATERIAL FOR THE SUB-BASE OF SYNTHETIC TURFS OR PAVINGS

(71) Applicant: Giuseppe De Maria, Caronno Varesino (IT)

(72) Inventor: Giuseppe De Maria, Caronno Varesino (IT)

( * ) Notice: Subject to any disclaimer, the term of this patent is extended or adjusted under 35 U.S.C. 154(b) by 0 days.

(21) Appl. No.: 16/052,306

(22) Filed: Aug. 1, 2018

(65) Prior Publication Data

US 2019/0040591 A1 Feb. 7, 2019

(30) Foreign Application Priority Data

Aug. 1, 2017 (IT) ..... 102017000088145

(51) Int. Cl.

| | |
|---|---|
| ***E01C 3/00*** | (2006.01) |
| ***E01C 13/02*** | (2006.01) |
| ***E02D 31/02*** | (2006.01) |
| ***E01C 13/08*** | (2006.01) |
| ***E01C 5/00*** | (2006.01) |

(52) U.S. Cl.

CPC ..... *E01C 13/02* (2013.01); *E01C 3/006* (2013.01); *E01C 5/001* (2013.01); *E01C 13/08* (2013.01); *E02D 31/025* (2013.01)

(58) Field of Classification Search

CPC ... E01C 3/00; E01C 3/06; E01C 13/00; E01C 13/02; E01C 3/006; E02D 31/025

USPC ..... 404/27–30, 34–38, 42, 45, 47

See application file for complete search history.

(56) References Cited

U.S. PATENT DOCUMENTS 1,636,113 A * 7/1927 Streator ..... E01C 3/006 404/29
2,082,563 A * 6/1937 Bauer ..... A63C 19/04 473/278
2,479,760 A * 8/1949 Merrick ..... B60B 39/12 238/14
2,512,310 A * 6/1950 Corson ..... A47G 27/0231 15/215
2,534,137 A * 12/1950 Lewis ..... F16F 1/376 428/169

(Continued)

FOREIGN PATENT DOCUMENTS

DE 19720006 A1 * 11/1998 ..... E01C 13/06
DE 102010045283 A1 3/2012

(Continued)

OTHER PUBLICATIONS

"Third Party Observations" re: Application No. EP 18185251.8, pp. 1-10; citing: WO 2011/036600 A2, U.S. Pat. No. 7,014,390 B1, KR 2012 0051861 A, MI2014A000896, US 2016/0333534 A1.

*Primary Examiner* — Thomas B Will
*Assistant Examiner* — Katherine J Chu
(74) *Attorney, Agent, or Firm* — Cantor Colburn LLP

(57) ABSTRACT

A mat made of waterproof plastic material for the sub-base of synthetic turfs or pavings and the like includes one or more coupling elements for mutual interconnection with other mats so as to compose a single turf for the complete covering of a predetermined bed surface. The mat is divided into at least two longitudinal portions which are mutually connected by an expansion joint component adapted to compensate for the thermal expansions and contractions by deforming.

7 Claims, 8 Drawing Sheets

(56) References Cited

U.S. PATENT DOCUMENTS 2,571,715 A * 10/1951 Henning ..... B29C 48/03 428/167
3,139,283 A * 6/1964 Lester ..... A63B 69/3661 473/278
4,211,366 A * 7/1980 Czarnota ..... B60B 39/12 238/14
4,374,442 A * 2/1983 Hein ..... E01D 19/06 14/73.1
4,403,009 A * 9/1983 Onderak ..... D06N 7/0005 156/285
4,436,779 A * 3/1984 Menconi ..... E01C 13/045 404/41
4,535,021 A * 8/1985 Friedrich ..... E01C 13/02 428/137
4,917,933 A * 4/1990 Schluter ..... E04B 1/762 428/99
5,195,679 A * 3/1993 Leeves ..... E01B 9/681 238/283
5,383,314 A * 1/1995 Rothberg ..... E02D 31/02 405/43
5,383,742 A * 1/1995 Grace ..... B60S 3/042 238/14
5,439,171 A * 8/1995 Fruend ..... B60B 39/12 152/208
5,862,983 A * 1/1999 Andrus ..... E01C 9/08 238/14
6,394,362 B1 * 5/2002 Kramr ..... B60B 39/12 238/14
6,531,203 B2 * 3/2003 Kessler ..... A47L 23/24 15/215
6,696,122 B1 * 2/2004 Deschamps ..... D03D 11/02 428/36.1
6,740,380 B2 * 5/2004 Kessler ..... A47L 23/24 428/45
6,802,159 B1 * 10/2004 Kotler ..... E01C 5/20 404/35
7,014,390 B1 * 3/2006 Morris ..... E02B 11/005 405/36
7,131,788 B2 * 11/2006 Ianniello ..... E01C 3/00 405/50
7,163,351 B1 * 1/2007 Shaver ..... E01C 9/083 15/53.1
7,300,224 B2 * 11/2007 Slater ..... E01C 9/086 404/36
8,061,927 B1 * 11/2011 Martinez ..... E01C 9/086 15/94
8,128,311 B2 * 3/2012 Son ..... A63C 19/04 403/326
8,225,566 B2 * 7/2012 Prevost ..... E01C 13/08 52/177
8,353,640 B2 * 1/2013 Sawyer ..... E01C 11/225 404/4
8,440,289 B2 * 5/2013 De Giuseppe ..... B32B 3/30 428/167
8,858,349 B2 * 10/2014 Vachon ..... E01C 3/006 472/92
9,878,579 B2 * 1/2018 Rosier ..... B60B 39/12
9,957,672 B2 * 5/2018 Rosier ..... E01C 9/08
10,137,639 B2 * 11/2018 Neill ..... B29C 66/1122
10,383,470 B2 * 8/2019 Weih ..... A47G 27/0231
10,415,193 B2 * 9/2019 Vachon ..... E01C 3/006
D886,333 S * 6/2020 Vachon ..... D25/163
2003/0156905 A1 * 8/2003 Hubert ..... E02D 31/02 405/229
2005/0214498 A1 * 9/2005 Nevison ..... E04F 15/10 428/44
2008/0176010 A1 * 7/2008 Sawyer ..... E01C 13/02 428/27
2008/0260459 A1 * 10/2008 Otto ..... E01C 5/20 404/18
2011/0289839 A1 * 12/2011 Cronk ..... A01G 9/025 47/65.7
2013/0306804 A1 * 11/2013 Holtby ..... B08B 17/025 248/49
2015/0361624 A1 * 12/2015 Rosier ..... E01C 9/08 404/35
2016/0333534 A1 11/2016 Capra
2018/0368604 A1 * 12/2018 Weih ..... H04L 63/10
2019/0270256 A1 * 9/2019 Neill ..... A47L 23/266

FOREIGN PATENT DOCUMENTS

IT MI2014A000896 11/2015
KR 1020120051861 A 5/2012
WO WO-9625035 A1 * 8/1996 ..... E01C 13/02
WO WO-03033318 A1 * 4/2003 ..... B60S 1/0848
WO 2011036600 A2 3/2011
WO WO-2011161157 A2 * 12/2011 ..... E01C 9/004

* cited by examiner

MAT MADE OF WATERPROOF PLASTIC MATERIAL FOR THE SUB-BASE OF SYNTHETIC TURFS OR PAVINGS

CROSS REFERENCE TO RELATED APPLICATIONS

This application is related to and claims the benefit of Italian Patent Application No. 102017000088145, filed on Aug. 1, 2017, the contents of which are herein incorporated by reference in their entirety.

TECHNICAL FIELD

The present disclosure relates to a mat made of waterproof plastic material for the sub-base of synthetic turfs or pavings and the like.

More in particular, the disclosure relates to a mat particularly but not exclusively useful and practical for providing playing fields made of synthetic grass.

BACKGROUND

The use of synthetic grass in playing fields has constituted a considerable advantage with respect to natural grass it requires less maintenance and allows a greater number of hours of use as it does not need water, chemical products or sunlight. Synthetic grass, that is applied in contexts in which, due to weather conditions, natural grass would not be able to grow, allows to play different sports even in extremely hot or cold regions. Obviously, some measures are nevertheless necessary. For example, if it used in high-rainfall contexts, correct runoff of rainwater must be ensured so as to avoid the forming of puddles or leaks of water in the ground below, which can jeopardize the use of the playing field.

In fact a ground, in order to be considered approved, i.e., suitable for carrying out a specific game, must comply with constraints imposed by the competent authorities (such as for example FIFA, amateur national leagues or the International Rugby Board) that might require for example that the ground is capable of absorbing to some extent shocks, such as impacts, falls, the passage of players and equipment.

These requirements might not be met in the event of adverse weather conditions. Therefore, when the synthetic grass is placed, it is necessary on the one hand to identify the requirements to be met (for example, for a rugby field, the shock absorption index must have a value that is higher than that of a tennis field) and on the other hand to ensure that the performance of the ground is met during the game.

In the prior art there are examples of materials that, when used together with synthetic grass, have the goal of improving ground performance.

A first example of the prior art is constituted by materials made of polyethylene foams with millings for water disposal. These materials not only require the additional installation of a sheath for waterproofing the sub-base but also show low resistance to compression and the risk of crushing in the short term with reduction of their draining ability.

A second example of the prior art is constituted by geo-composite materials made of polypropylene and wrapped with geotextile material. These materials, too, require the additional installation of a sheath in order to waterproof the sub-base and also show low resistance to compression and poor performance particularly in terms of shock absorption.

A third example of materials of the prior art comprises sheets made of polypropylene and molded by injection as grids provided with an underlying wing. These materials, besides being rigid and prone to break if subjected to loads, require an elaborate installation due to the need to fix the sheets with metal eyelets in order to avoid their movement. Moreover, in this case also it is necessary to lay a waterproofing sheath and geotextile material on the surface.

Another example is constituted by materials molded in polyethylene sheets that require the use of a waterproofing sheath. These materials are very expensive.

A last example is constituted by the use of a plurality of rubber mats, usually quadrangular and provided with ribs, which are arranged side by side so as to cover the entire surface of the playing field.

Even rubber mats of the known type, albeit very useful and practical, are lacking in some aspects.

First of all it is very difficult, during laying, to obtain perfect spreading and precise alignment of the various mat portions.

Furthermore, because of the intense and repeated stresses (such as for example, rebounds, "sliding tackles" of the players, treading, transit of apparatuses and heavy equipment . . . ) to which they are subjected during use, the mat portions tend to move and misalign.

Another disadvantage of mat portions of the known type is constituted by the fact that water draining is uneven and undesired accumulations of water form following rainfall, with consequent formation of puddles and accordingly, over time, also of hollows and/or bulges in the turf above.

Another very important drawback, which occurs in mat portions of the known type, is constituted by thermal expansion.

In fact, following the rise of the temperature, the material of which the mats are made expands and the mats increase their dimensions considerably (expansions up to 5 mm on a width of 1200 mm have been observed) and thus push against each other, with consequent creation of corrugations, bulges, misalignments.

Vice versa, following the lowering of the temperature, the material contracts, with the consequent creation of tractions, stresses, misalignments and ruptures.

SUMMARY

The aim of the present disclosure is to overcome the limitations of the background art highlighted above, providing a new mat capable of obviating the problems caused by thermal expansion and contraction.

Within this aim, the present disclosure provides a mat that is easy to deploy and at the same time ensures stability and correct alignment over time.

The disclosure also provides a mat that avoids unwanted accumulations of rainwater.

The disclosure further provides a mat that is easy to manufacture and economically competitive if compared with the prior art.

The disclosure also provides a synthetic turf arrangement that ensures good-level and lasting performance and an efficient draining of rainwater.

The present disclosure further provides a method for producing a mat portion adapted to be used as sub-base for synthetic turfs.

This aim and these and other advantages that will become better apparent hereinafter are achieved by providing a mat according to claim 1.

This aim and these and other advantages are also achieved by providing a ground according to claim 10.

This aim and these and other advantages are also achieved by providing a method according to claim 11.

BRIEF DESCRIPTION OF THE DRAWINGS

Further characteristics and advantages will become better apparent from the description of a preferred but not exclusive embodiment of a mat according to the disclosure, as well as of a method for producing the mat, illustrated by way of non-limiting example with the aid of the accompanying drawings, wherein.

DETAILED DESCRIPTION OF THE DRAWINGS

Figure 1:
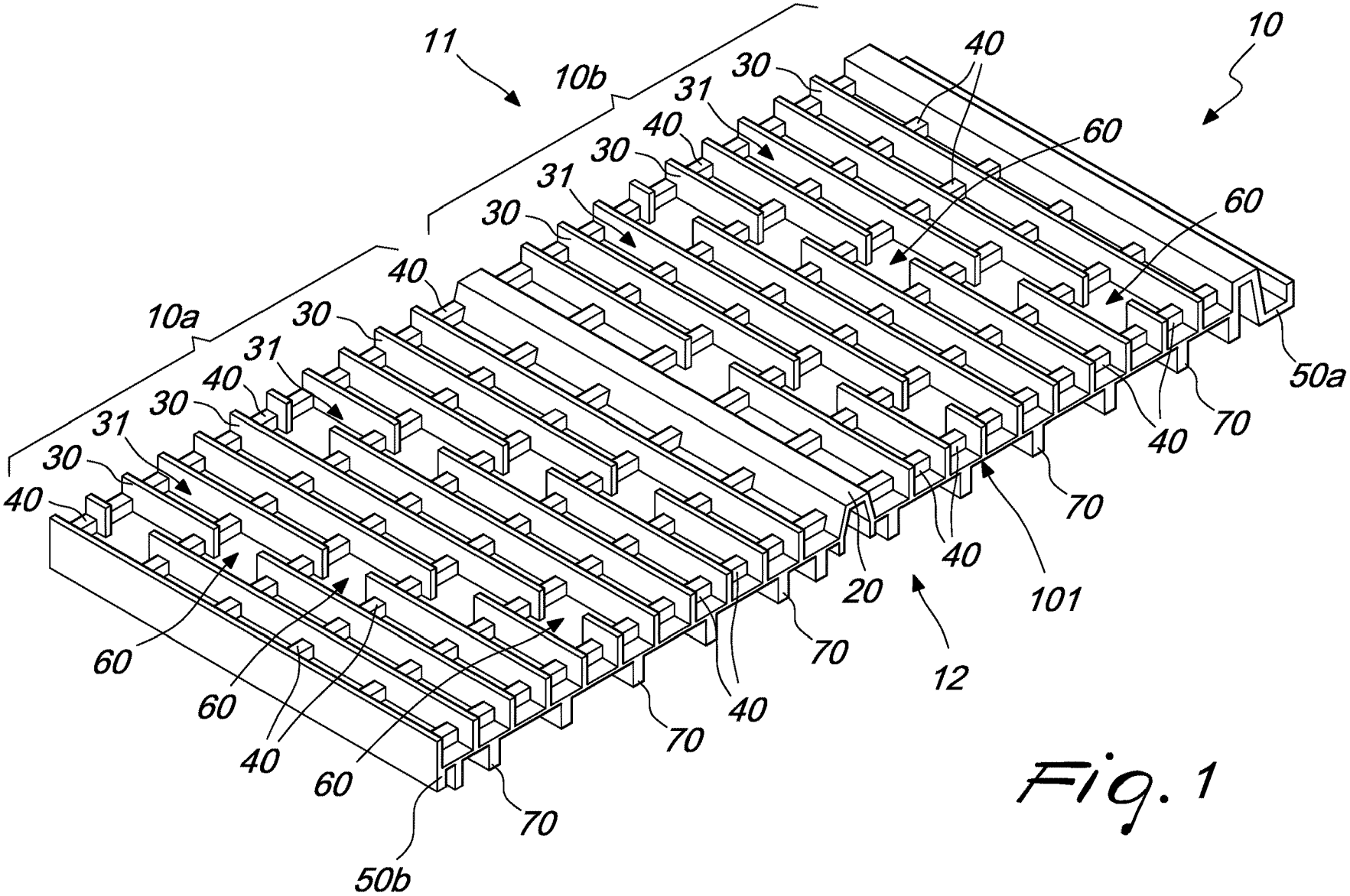
FIG. 1 is a perspective view of a possible embodiment of a mat according to the disclosure.
Figures 2, 3:
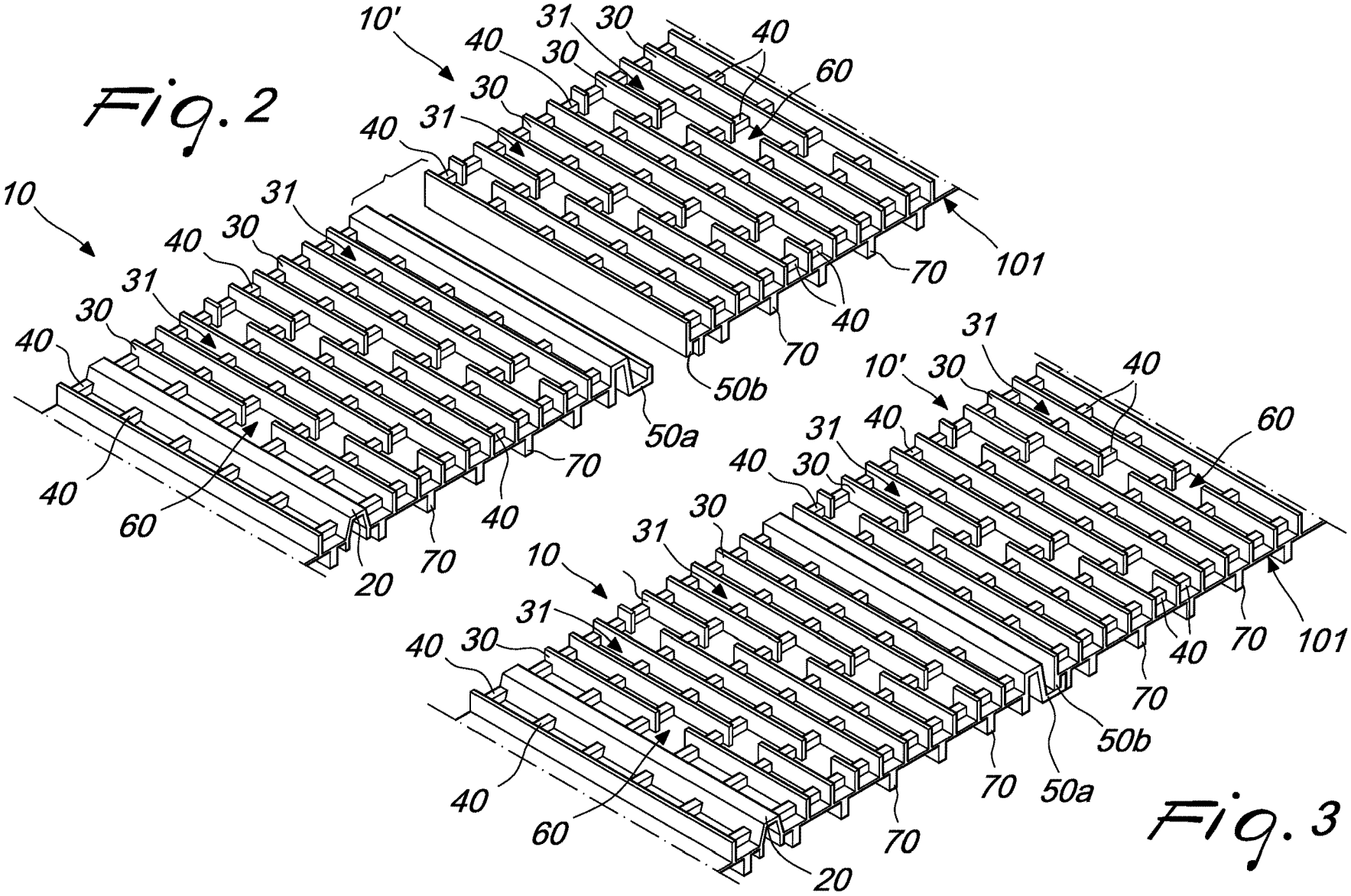
FIG. 2 is a perspective view of two portions of mats arranged side by side.
FIG. 3 is a perspective view of two portions of connected mats.
Figure 4:
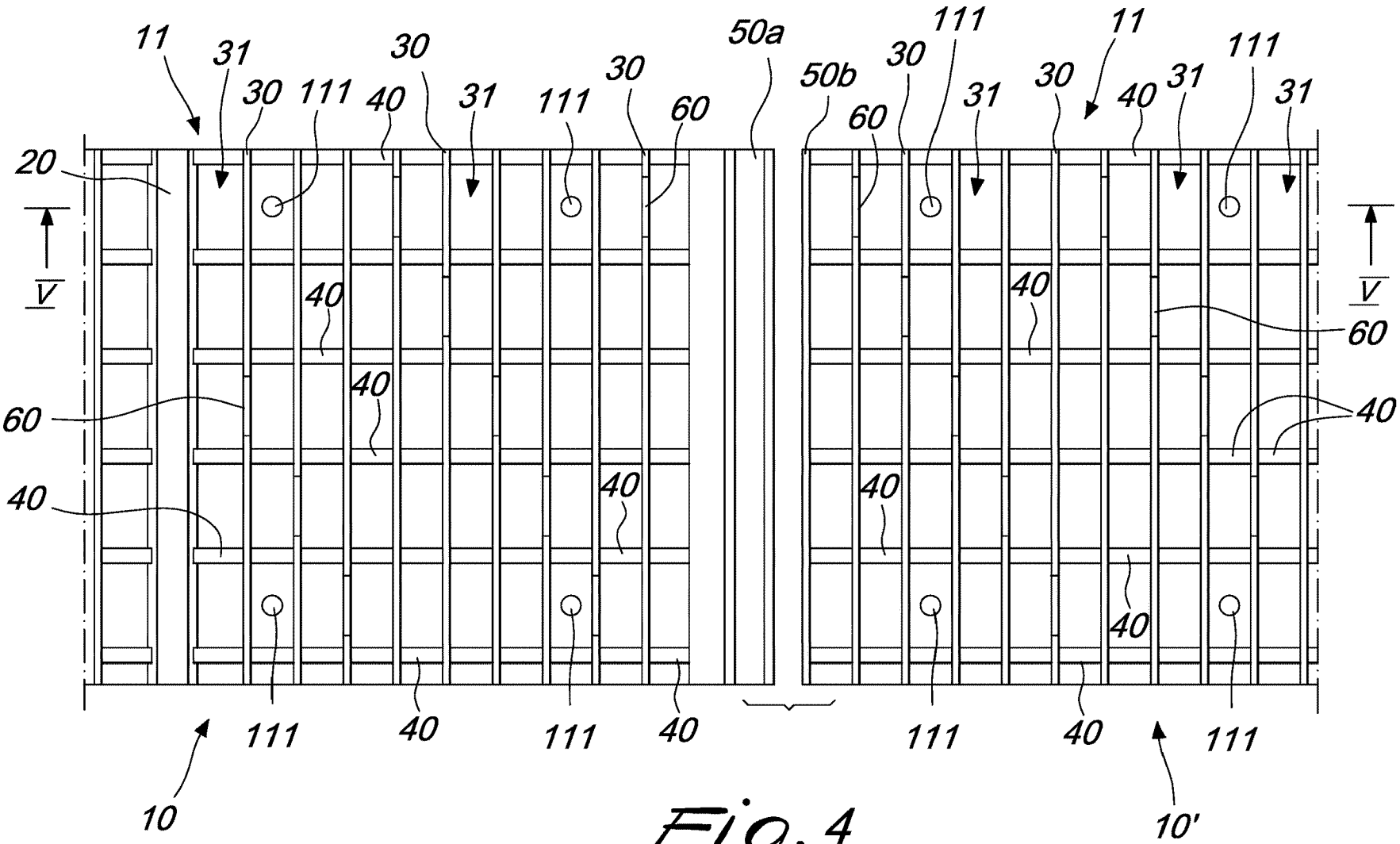
FIG. 4 is a plan view of the upper face of the mats of FIG. 2.
Figure 5:
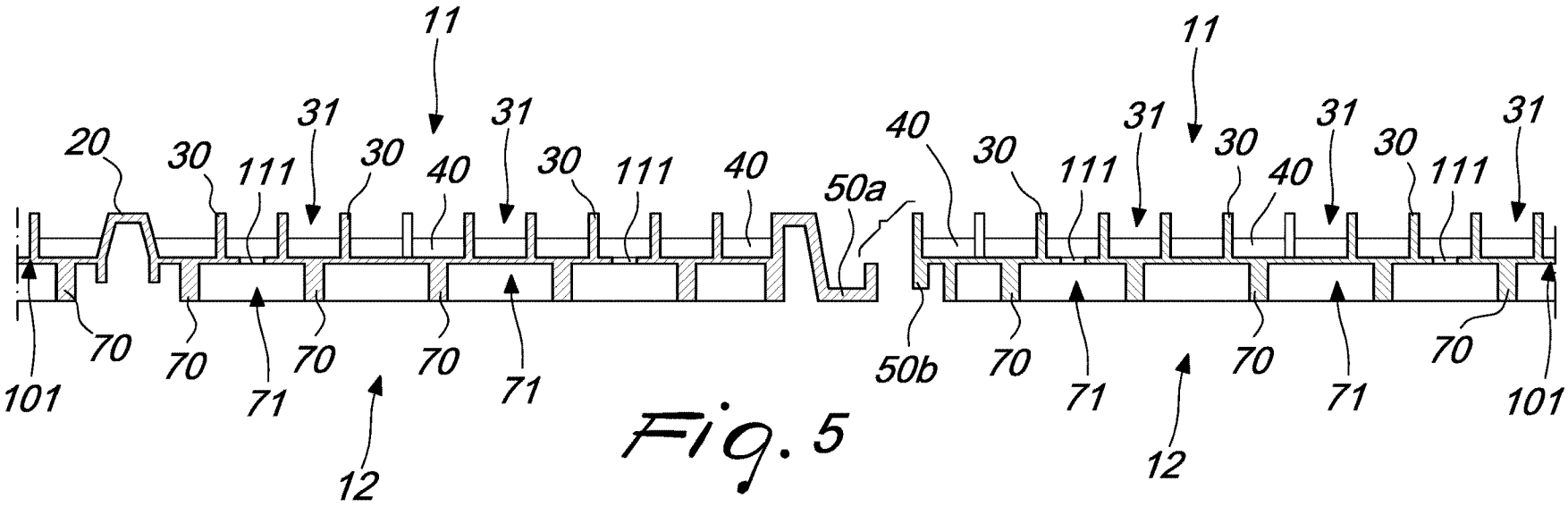
FIG. 5 is a sectional view, taken along the plane V, of the mats of FIG. 4.
Figure 9:
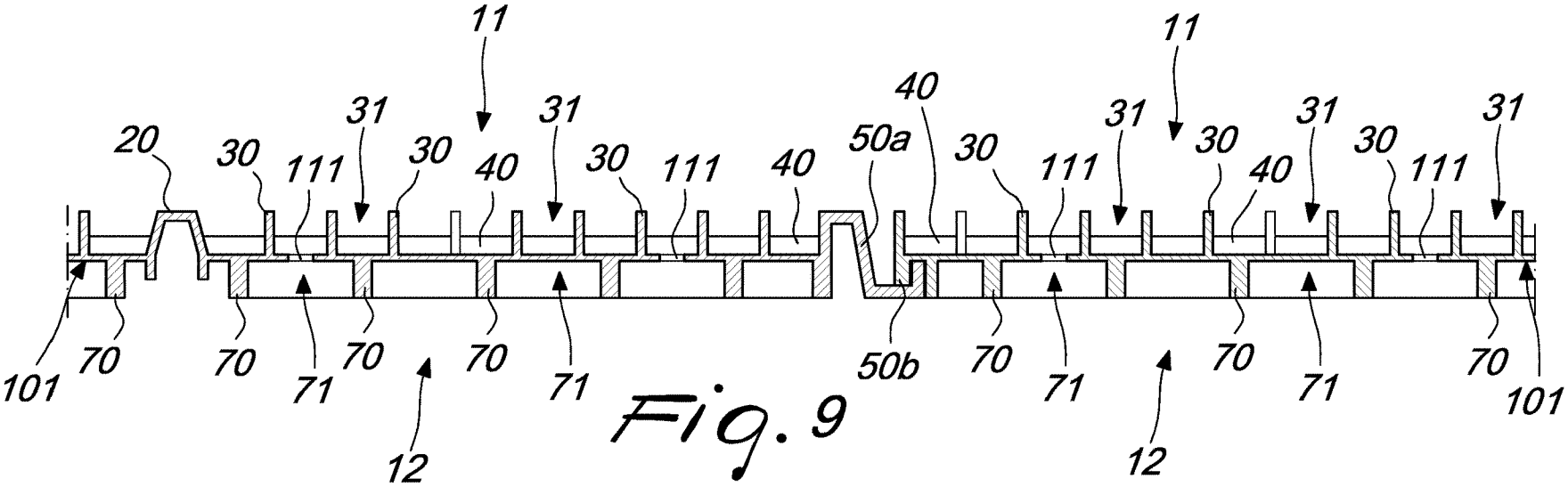
FIG. 9 is a sectional view taken along the plane V of the mats of FIG. 8.

With reference to FIGS. 1-11, the mat, generally designated by the numeral 10, is adapted to be arranged between a bed surface 201 and a covering layer 202. The bed surface 201 is usually constituted by the natural ground 201*a* on which generally a layer of stabilizing material 201*b* is laid. The covering layer 202 is constituted preferably by synthetic grass 202*c*, with sand, gravel or any other type of walking or covering surface inside it.

More precisely, the mat 10 is designed to be connected to other mats 10', so as to compose a single turf for the complete covering of a preset bed surface 201 (for example for the complete covering of a football field). For this purpose, the mat 10 comprises at least one coupling element 50*a*, 50*b* for mutual interconnection with other mats 10'. In the preferred and illustrated embodiment, the coupling element 50*a*, 50*b* is constituted by two concave protrusions 50*a*, 50*b*, which are mutually complementary, each arranged at a longitudinal end of the mat portion 10 and shaped so as to be mutually coupled, forming a waterproof engagement system.

Again with reference to the figures, the mat 10 comprises a membrane 101 which in turn comprises a lower face 12 adapted to be rested on the bed surface 201 and an upper face 11 adapted to be covered by the covering layer 202.

Both the upper face 11 (shown in FIGS. 1 to 4) and the lower face 12 (shown in FIGS. 6, 7, and 8), comprise a plurality of ribs 30, 40, 70 adapted to absorb and return mechanical stresses.

In practice, these ribs 30, 40, 70 are protrusions of the membrane 101, which protrude from the two faces 11, 12 and form, as will be explained hereinafter, lines 30, ridges 40, channels 31 and receptacles 71 having shapes and dimensions that depend on the specific use for which the mat 10 is intended. In particular, the mat 10, according to the disclosure, is characterized by a flexing parameter associated to the deformation of said ribs 30, 40, 70. It is thus possible to set this flexing parameter, for example based on the specifications imposed by regulations for a specific playing field, by sizing conveniently the ribs 30, 40, 70.

According to the disclosure, the mat 10 further comprises at least one expansion joint 20 adapted to compensate for the thermal deformations by deforming.

The expression "expansion joint" 20 designates a deformable element, comprising a cavity and/or concavity, that joins two longitudinal portions (10*a*, 10*b*) of the mat and preferably occupies the entire length of the mat 10.

In the preferred and illustrated embodiment, the expansion joint 20 is shaped like an arch with a substantially C-shaped cross-section and the cavity oriented downward (i.e., toward the bed surface 201 when the mat 10 is laid), which occupies the entire width of the mat 10 and in practice divides the mat 10 into two or more distinct longitudinal portions 10*a*, 10*b* mutually connected by said expansion joint 20 (see FIG. 1).

The expansion joint 20 has the characteristic of being easily deformable; in this manner, when the membrane 101 is subjected to a thermal expansion, the expansion joint 20 deforms by contracting its own cavity, allowing the two longitudinal portions 10*a*, 10*b* to move closer and thus preventing the overall dimensions of the mat 10 from varying.

Likewise, when the membrane 101 is subjected to a thermal contraction following a temperature decrease, the expansion joint 20 deforms, widening its own cavity, allowing the two longitudinal portions 10*a*, 10*b* to move apart and thus preventing the total dimensions of the mat 10 from varying.

In this manner the problems caused by thermal expansion and contraction to which mats of the known type are subjected are avoided.

Furthermore, the expansion joint 20 keeps the mat 10 stretched by keeping the longitudinal portions 10*a*, 10*b* separate. In this manner, the deployment of the mat 10 is easier and more precise.

According to an optional characteristic, there are also connection means 50*a*, 50*b* for mutually connecting various mats 10, 10' made to match up during deployment, for even greater assurance of stable alignment.

In the example shown there is a single expansion joint 20, but according to the disclosure the mat 10 can comprise further expansion joints 20 that divide the mat into a plurality of sectors 10*a*, 10*b*.

Figure 6:
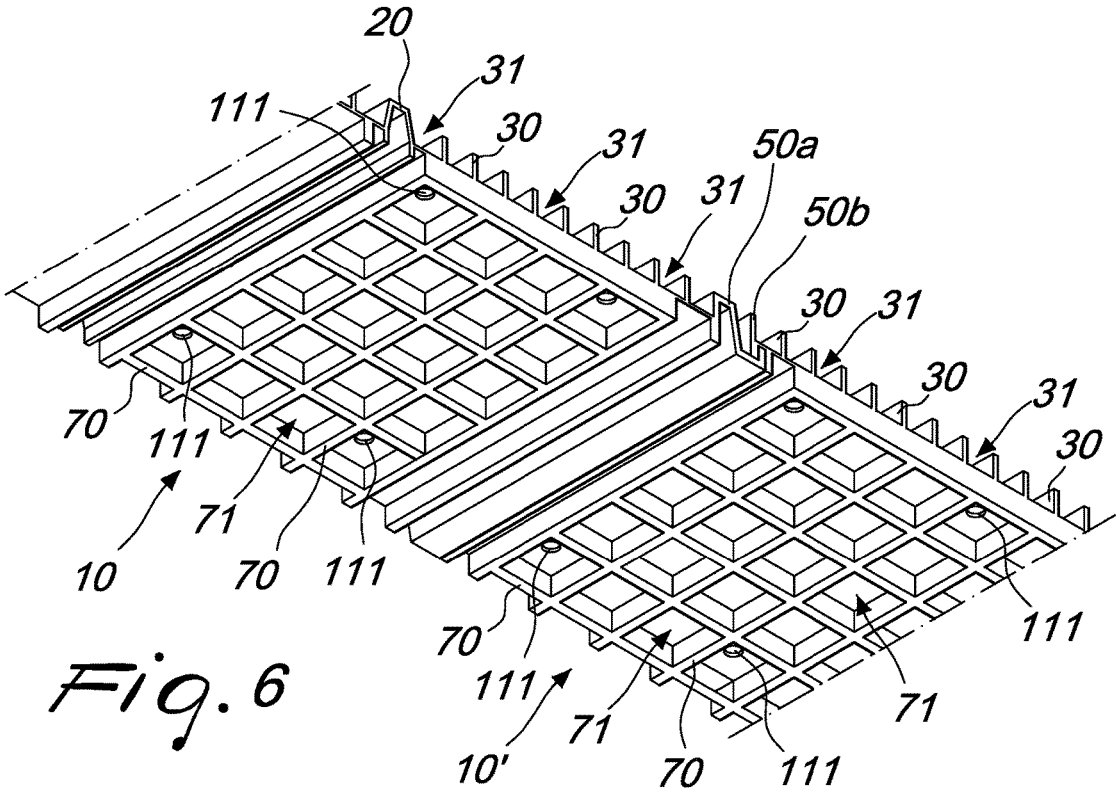
FIG. 6 is a bottom perspective view of the lower faces of the mats of FIG. 3 connected.
Figure 7:
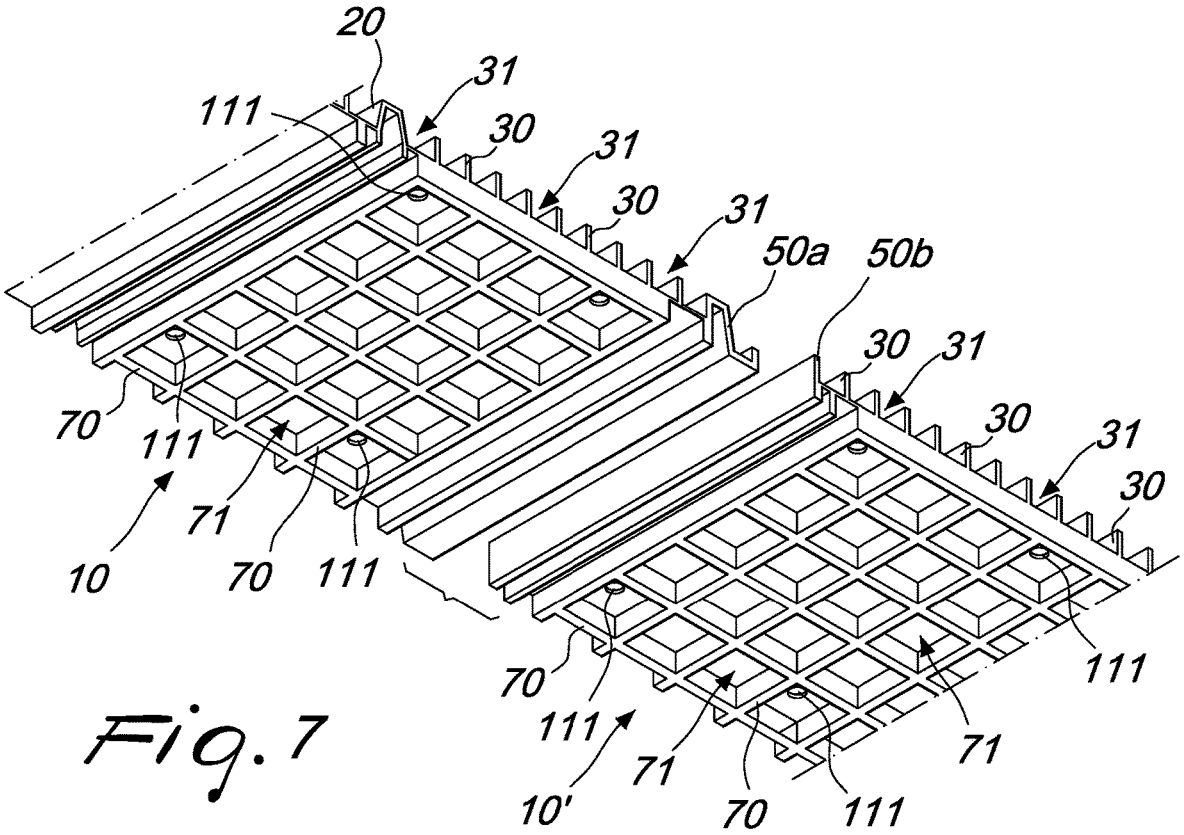
FIG. 7 is a bottom perspective view of the lower faces of the mats of FIG. 2 arranged side by side.
Figure 8:
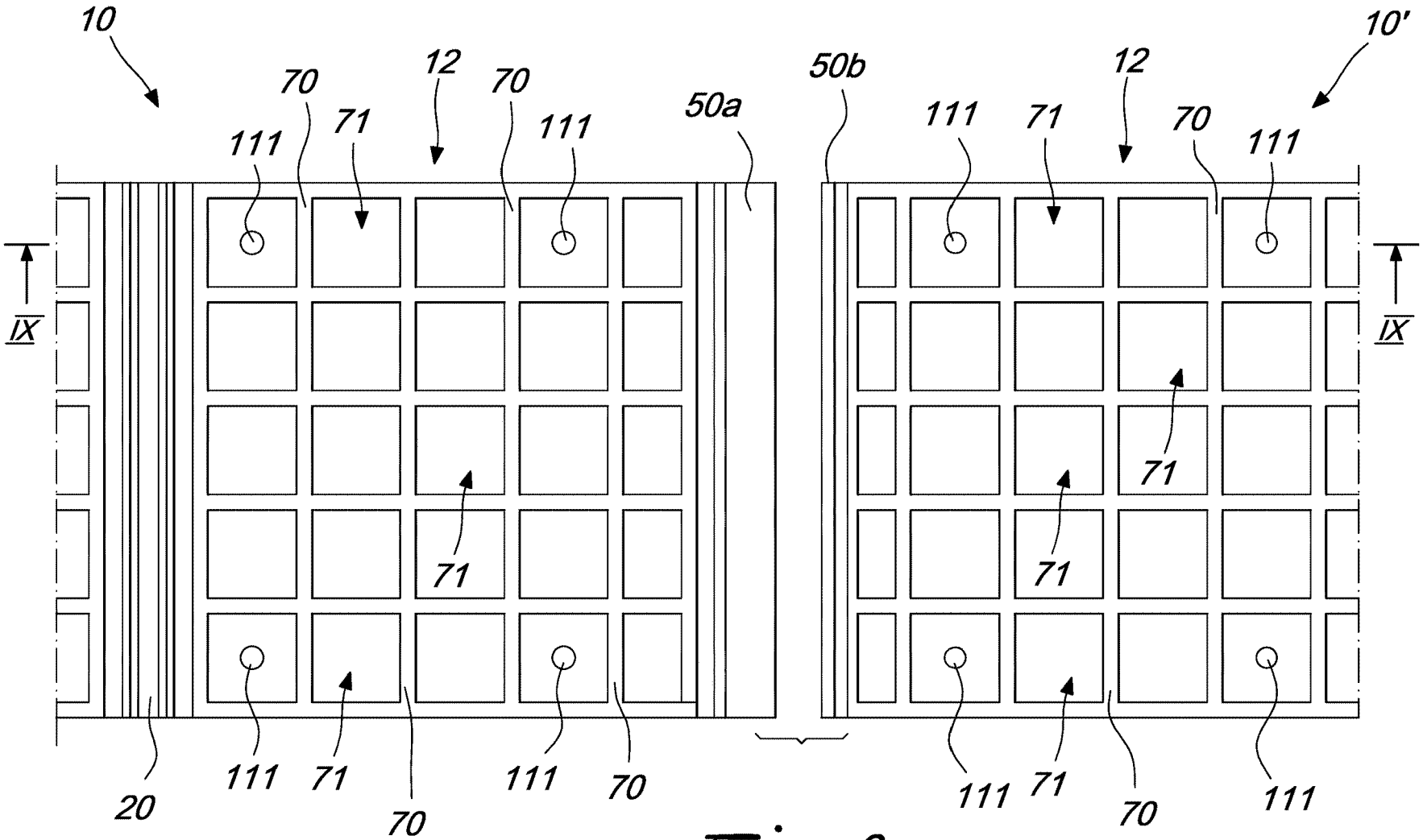
FIG. 8 is a plan view of the lower face of the mats of FIG. 2.

In the preferred and illustrated embodiment, with particular reference to FIGS. 6, 7 and 8, the ribs 30, 40, 70 form on the lower face 12 a plurality of receptacles 71.

The expression "receptacle" 71 is understood to reference an open sector delimited by walls 70. Preferably, the receptacles 71 have a square shape, forming, on the lower face 11, a grid with a specific spacing (i.e., the distance between the ribs 70 that constitute the walls 70 of the receptacles 71).

In the same embodiment, as shown in particular in FIGS. 1 to 4, on the upper face 11 the ribs 30, 40, 70 comprise longitudinal lines 30 that form channels 31 for the horizontal draining of water.

In other words, the ribs 30 form, on the upper face 11, straight walls, which are mutually parallel, extend transversely from one side to the other of the mat 10 and mutually define a series of channels 30 in which the water can flow.

In fact, as will be described hereinafter in an example of application of a plurality of mats according to the disclosure, the mats 10, 10' are usually arranged so as to have an appropriate inclination that facilitates the draining of water on the upper face 11.

The presence of the channels 31 cause a draining of water that is uniform along all of the upper face 11 and prevents the forming of unwanted stagnations.

Preferably, on the upper face 11, the ribs 30, 40, 70 also comprise transverse ridges 40 that are less high than the longitudinal lines 30 and are adapted to create accumulations of water.

In practice, these transverse ridges 40 are perpendicular to the longitudinal lines 30, connecting to each other the longitudinal lines 30 and forming barriers that retain a water layer on the bottom of the channels 31.

The advantage of this solution resides in that the water layer retained by the transverse ridges helps to keep the temperature of the system low and even.

Here, it should be noted that this water layer, contrary to the unwanted accumulations of water that the disclosure seeks to avoid, has a depth equal to the height of the transverse ridges 40 and can be thus conveniently preset so as to not interfere with the overlying covering layer 202.

Advantageously, the transverse ridges 40 have a spacing that is equal to the spacing of the receptacles 41, i.e., the distance between the transverse ridges 40 is equal to the distance between the walls 70 that form the receptacles 71 and each transverse ridge 40 is arranged at an underlying wall 70. In this manner, the transverse ridges 40 also help to strengthen the structure of the mat 10 without jeopardizing its flexibility.

According to an optional and advantageous characteristic, on the longitudinal lines 30 there are one or more cuts 60 for the passage of water between at least two channels 31. In practice, the cuts 60 create passages through the longitudinal lines 30 by means of which the water can drain from one channel 31 to the other. In this manner a more even distribution of the water flow is allowed and excessive hydraulic pressures are avoided in the event of intense rainfall.

Optionally, the mat 10 further comprises one or more holes 111 for the passage of water through the membrane 101, i.e., for the draining of a certain quantity of water from the covering layer 202 toward the bed surface 201.

In practice, in the preferred embodiment, all the elements described so far are provided by the shaping of a single piece of waterproof plastic material. Preferably, this waterproof plastic material is constituted by a mixture 90 composed of 15-25% thermoplastic polymer and 75-85% rubber obtained from used tires (ELTs, end-of-life tires).

Moreover, the mat 10 can further comprise a filter (not shown) interposed between the upper face 11 and the covering layer 202, preferably composed of a nonwoven fabric (NWF) or needle-tufted fabric, for filtering the sand that arrives from the covering layer 202 and for protection from solar radiation.

Figure 10:
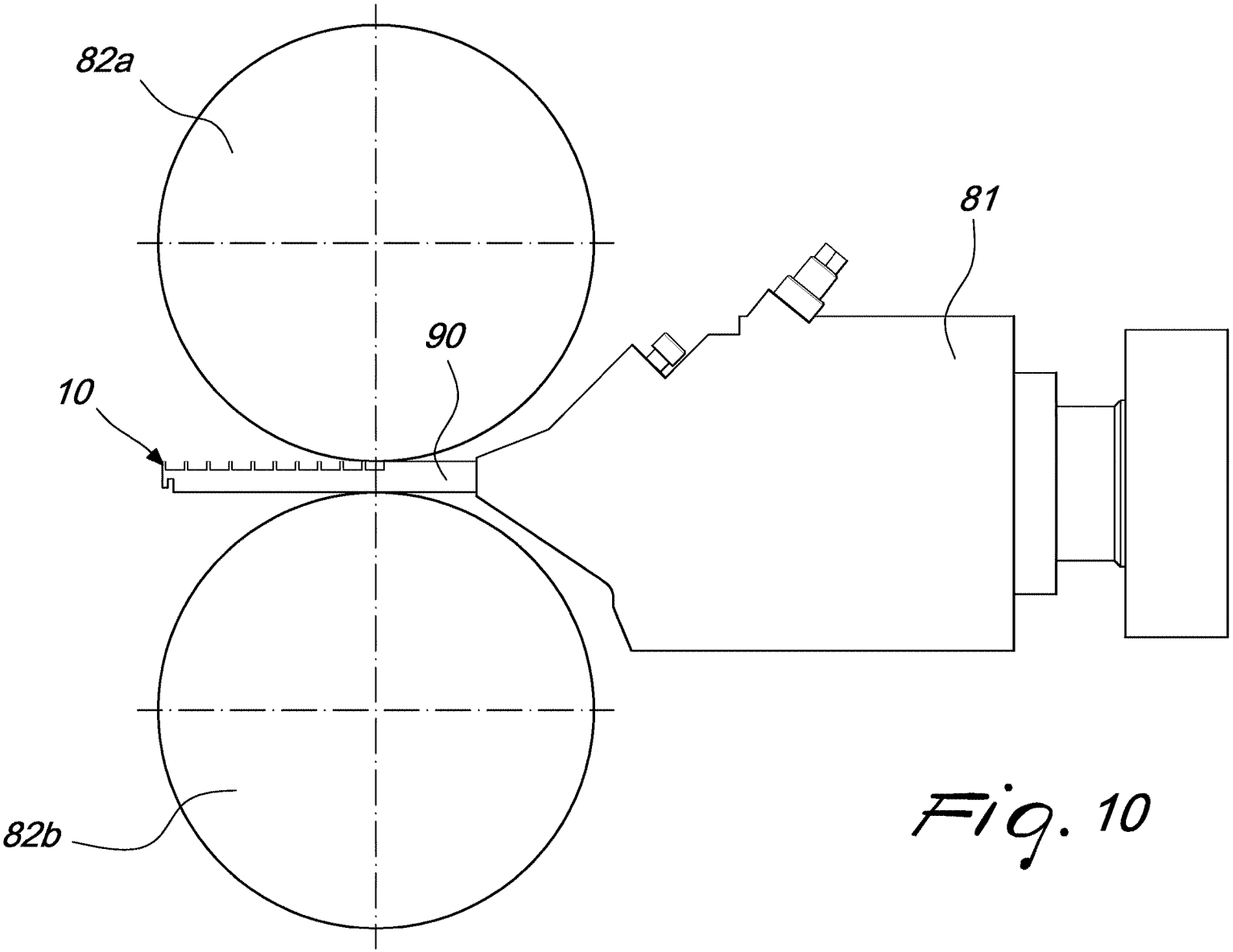
FIG. 10 is a schematic view of a system for the production of the mat according to the present disclosure.

A preferred method for the production of mats 10 according to the disclosure is shown schematically in FIG. 10. According to this method, the thermoplastic mixture 90 exits in the plastic state from a flat head of an extruder 81 and it is then calendered by passing between two conveniently contoured rollers 82*a*, 82*b*. As known in the art, calendering is a process that is performed in machines (calenders) composed of rollers with parallel axes, having an adjustable distance, which roll at low speed; it involves making the plastic material pass in the semisolid state between the pairs of rollers.

The method, according to the disclosure, entails that the rollers 82*a*, 82*b* of the calender are conveniently contoured so as to give the mixture 90 the shape of the finished mat 10, without requiring further processes.

Preferably, the clearance between the two rollers 82*a*, 82*b* is approximately 0.3 mm, so as to create a strong compression on the finished part.

Moreover, the rollers 82*a*, 82*b* are cooled, thus causing, besides the plastic deformation, also the cooling of the mixture 90. Preferably, this cooling occurs by bringing the rollers 82*a*, 82*b* to a temperature of approximately 7° C., so that the shrinkages of the material are minimal.

Figure 11:
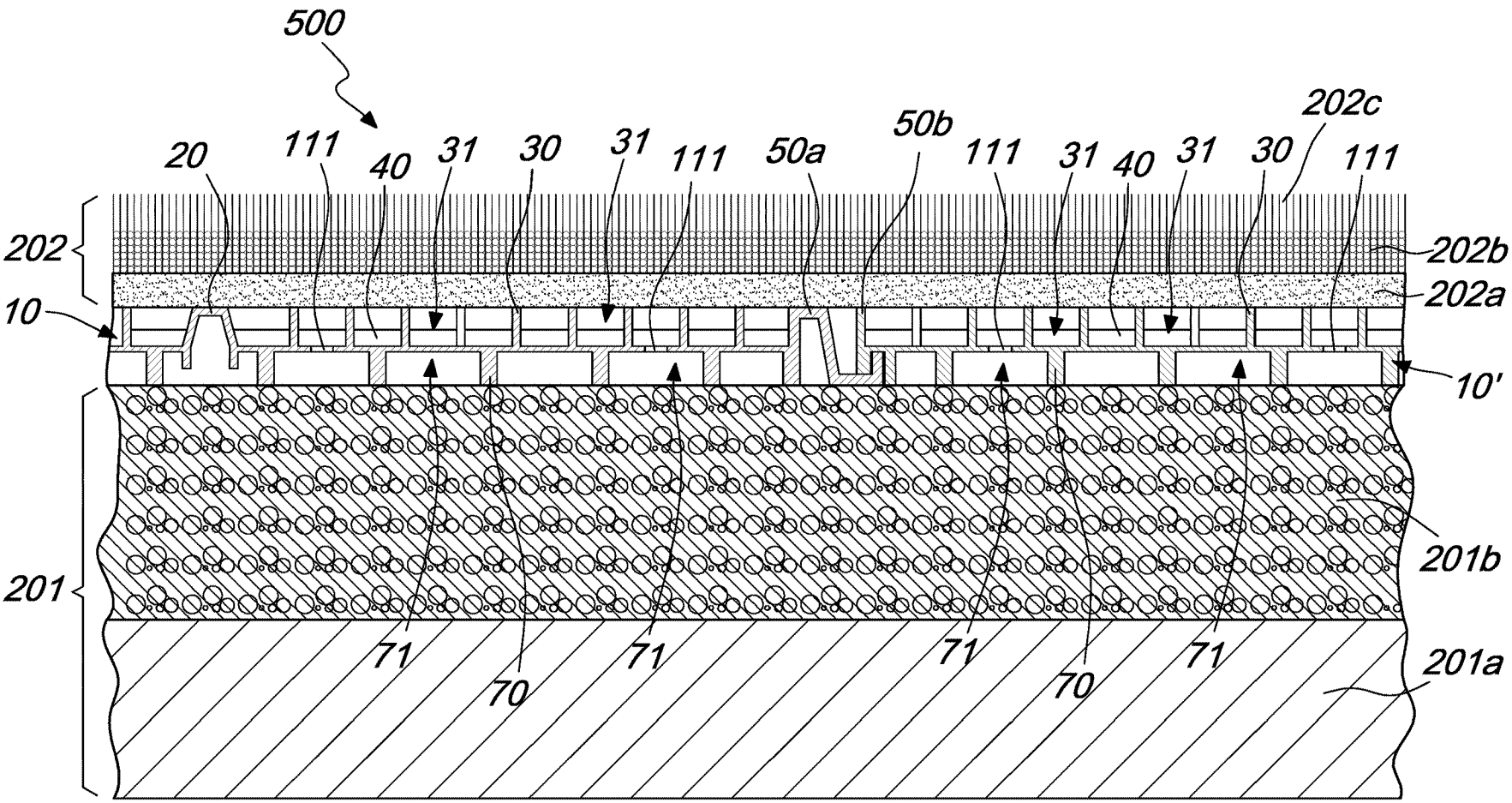
FIG. 11 is a view of a playing field in which multiple mats according to the present disclosure are used.

FIG. 11 shows an example of a playing field 500 made of synthetic grass, in which a plurality of mats 10, 10' according to the disclosure are used.

The playing field 500 shown comprises a plurality of mats 10, 10' interposed between a bed surface 201 and a covering layer 202. In greater detail, in the illustrated example, the bed surface 201 comprises a base of natural ground 201*a* on which stabilized ground 201*b* or inert recovered materials mixed with stabilizing agents is deposited. The stabilized ground 201*b* is hard and consolidated and is adapted to accommodate a plurality of mats 10, 10', so as to give them such an inclination as to allow horizontal draining, i.e., toward the longitudinal sides of the playing field, of water.

On the stabilized ground 201*b* there are therefore multiple mats 10, 10', which are mutually connected by means of the coupling elements 50*a*, 50*b*, so as to form a single waterproof turf, even with glue on the joint. Although the figure shows only two mats 10, 10', the person skilled in the art understand without any inventive effort that other mats can be added until the entire playing area is covered.

Finally, the mats 10, 10' are covered by a covering layer 202 which in this example comprises, in the following order, crushed siliceous sand 202*a*, rubber granules 202*b*, synthetic grass 202*c*. The mats 10, 10' according to the present disclosure, together with the layers 202*a*, 202*b*, 202*c*, allow to absorb shocks, contain vertical deformation and stresses so as to meet the international regulations of the competent authorities, such as FIFA, with shock absorption of the system starting from 55% up to 70% and vertical deformation from 4 mm to 8 mm. Optionally, between the covering layer 202 and the mats 10, 10' it is possible to insert, if advantageous, a filter of the non-woven fabric, NWF, type.

As already explained, even if the turf has been presented mainly with regard to use on playing fields, it could also find other applications where the draining of water is required, such as for example in landfills, terraces, gardens as casing of tubes or also as protective layer under dry-lay pavings, road pavings, ballasts, etcetera.

In practice it has been found that the mat 10, according to the present disclosure, fully achieves the intended aims and advantages because the disclosure is capable of obviating the problems caused by thermal expansion and contraction.

Another advantage of the mat according to the disclosure is that it is easy to lay, ensuring at the same time stability and correct alignment over time.

A further advantage of the mat, according to the disclosure is that it avoids unwanted accumulations of water.

Another advantage of the mat according to the disclosure is that it is easy to provide and economically competitive if compared with the background art.

A further advantage of the mat according to the disclosure is that it allows the provision of playing fields that give the greatest assurances of reliability and safety in use and meet all the parameters set by regulations.

The mat thus conceived is susceptible of numerous modifications and variations.

All the details may furthermore be replaced with other technically equivalent elements.

In practice, the materials used, so long as they are compatible with the specific use, as well as the contingent shapes and dimensions, may be any according to the requirements and the state of the art.

What is claimed is:

1. A mat made of waterproof plastic material adapted to be arranged between a bed surface and a covering layer, said mat comprising:

a membrane including a lower face adapted to be rested on said bed surface and an upper face adapted to be covered by said covering layer; and one or more coupling elements for mutual interconnection with other mats so as to compose a single turf for the complete covering of said bed surface;

said lower face and said upper face comprising a plurality of ribs adapted to absorb and return mechanical stresses;

wherein the mat is divided into at least two longitudinal portions mutually connected by means of an expansion joint adapted to compensate for the thermal expansions and contractions by deforming, wherein said ribs comprise longitudinal lines which form channels for the horizontal draining of the water on said upper face, wherein on said upper face said ribs also comprise transverse lines which are lower than said longitudinal lines and are adapted to create accumulations of water and wherein one or more cuts for the passage of water between at least two of said channels are provided on said longitudinal lines.

2. The mat according to claim 1, wherein said ribs form a plurality of receptacles on said lower face.

3. The mat according to claim 2, wherein said transverse lines have a spacing equal to the spacing of said receptacles.

4. The mat according to claim 1, further comprising one or more holes for the passage of water through said membrane.

5. The mat according to claim 1, wherein said waterproof plastic material is constituted by a mixture composed of 15-25% thermoplastic polymer and 75-85% rubber, said rubber being obtained from used tires.

6. The mat according to claim 1, further comprising a filter arranged above said upper face, said filter comprising material of the nonwoven fabric type.

7. A playing field comprising a bed surface and a covering layer, said covering layer comprising at least one layer of synthetic grass, and further comprising, between said covering layer and said bed surface, a plurality of mats according to claim 1.

* * * * *